US007384354B2

(12) United States Patent
Giannetti

(10) Patent No.: US 7,384,354 B2
(45) Date of Patent: Jun. 10, 2008

(54) SINGLE WALL BALL BAT INCLUDING QUARTZ STRUCTURAL FIBER

(75) Inventor: William B. Giannetti, Winnetka, CA (US)

(73) Assignee: Easton Sports, Inc., Van Nuys, CA (US)

( * ) Notice: Subject to any disclaimer, the term of this patent is extended or adjusted under 35 U.S.C. 154(b) by 0 days.

(21) Appl. No.: 11/560,499

(22) Filed: Nov. 16, 2006

(65) Prior Publication Data

US 2007/0202974 A1 Aug. 30, 2007

(51) Int. Cl.
*A63B 59/06* (2006.01)

(52) U.S. Cl. ..... 473/567

(58) Field of Classification Search ..... 473/564–568, 473/457, 519, 520

See application file for complete search history.

(56) References Cited

U.S. PATENT DOCUMENTS

| | | | |
|---|---|---|---|
| 3,129,003 | A | 4/1964 | Mueller et al. |
| 3,830,496 | A | 8/1974 | Reizer |
| 4,014,542 | A | 3/1977 | Tanikawa |
| 4,025,377 | A | 5/1977 | Tanikawa |
| 4,092,025 | A | 5/1978 | Yanagioka |
| 4,505,479 | A | 3/1985 | Souders |
| 4,848,745 | A | 7/1989 | Bohannan et al. |
| 5,114,144 | A | 5/1992 | Baum |
| 5,301,940 | A | 4/1994 | Seki et al. |
| 5,303,917 | A | 4/1994 | Uke |
| 5,364,095 | A | 11/1994 | Easton et al. |
| 5,395,108 | A | 3/1995 | Souders et al. |
| 5,415,398 | A | 5/1995 | Eggiman |
| 5,651,740 | A | 7/1997 | Munoz |
| 5,676,610 | A | 10/1997 | Bhatt et al. |
| 6,036,610 | A | 3/2000 | Lewark |
| 6,042,493 | A | 3/2000 | Chauvin et al. |
| 6,053,828 | A | 4/2000 | Pitsenberger |
| 6,139,451 | A | 10/2000 | Hillerich, III et al. |
| 6,238,309 | B1 | 5/2001 | Sample |
| 6,287,222 | B1 | 9/2001 | Pitsenberger |
| 6,322,463 | B1 | 11/2001 | Forsythe et al. |
| 6,352,485 | B1 | 3/2002 | Philpot et al. |
| 6,425,836 | B1 | 7/2002 | Misono et al. |
| 6,461,260 | B1 | 10/2002 | Higginbotham |
| 6,482,114 | B1 | 11/2002 | Eggiman et al. |
| 6,485,382 | B1 | 11/2002 | Chen |
| 6,702,698 | B2 | 3/2004 | Eggiman et al. |
| 6,723,012 | B1 | 4/2004 | Sutherland |
| 6,733,404 | B2 | 5/2004 | Friske et al. |
| 6,755,757 | B2 | 6/2004 | Sutherland |
| 6,764,419 | B1 | 7/2004 | Giannetti et al. |
| 6,776,735 | B1 | 8/2004 | Belanger et al. |

(Continued)

FOREIGN PATENT DOCUMENTS

EP 0548930 A1 * 6/1993

*Primary Examiner*—Mark S Graham
(74) *Attorney, Agent, or Firm*—Perkins Coie LLP

(57) ABSTRACT

A single-wall ball bat is made up of a series of layers or plies of unidirectional, two-dimensional, structural fibers having high strain energy properties. The plies are optionally layered upon each other in a lamina structure in which the fibers in one ply are oriented at opposing angles to the fibers in one or more neighboring plies. High purity quartz ($SiO_2$) fibers, which have very high strain energy properties, may be used to construct substantial portions of the barrel or other regions of the ball bat.

14 Claims, 2 Drawing Sheets

U.S. PATENT DOCUMENTS 6,808,464 B1 10/2004 Nguyen
6,866,598 B2 3/2005 Giannetti et al.
6,878,080 B2 4/2005 Chang
6,929,573 B1 8/2005 Chang

* cited by examiner

FIG. 1
PRIOR ART
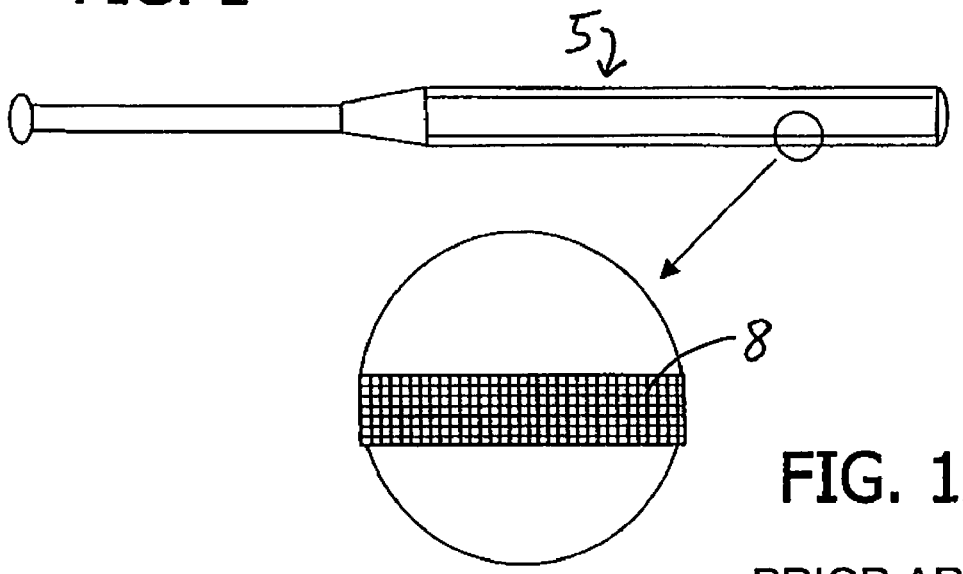
FIG. 1A
PRIOR ART
FIG. 2
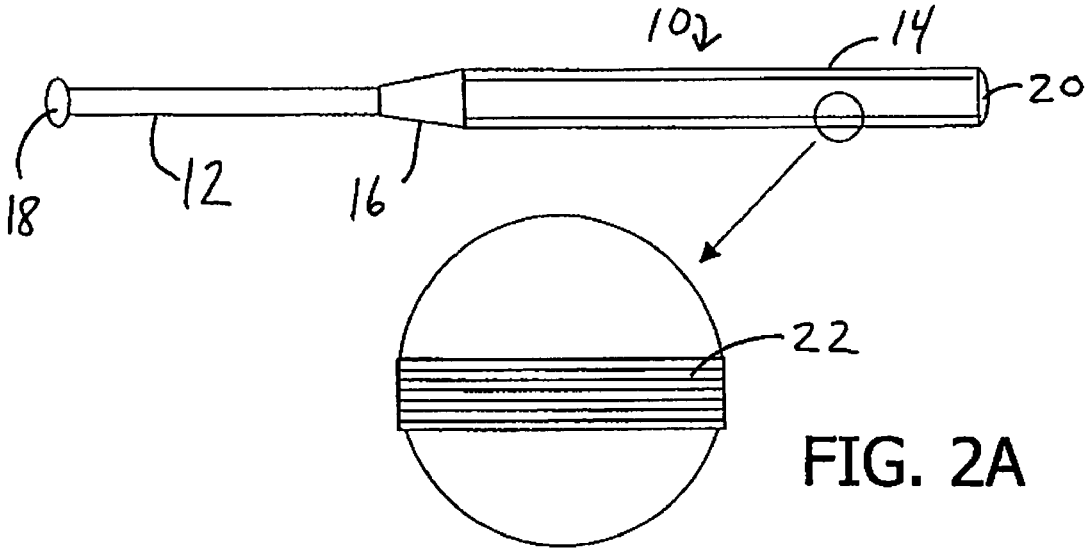
FIG. 2A

FIG. 3
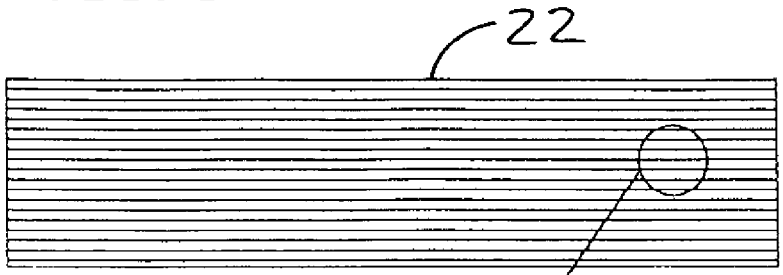
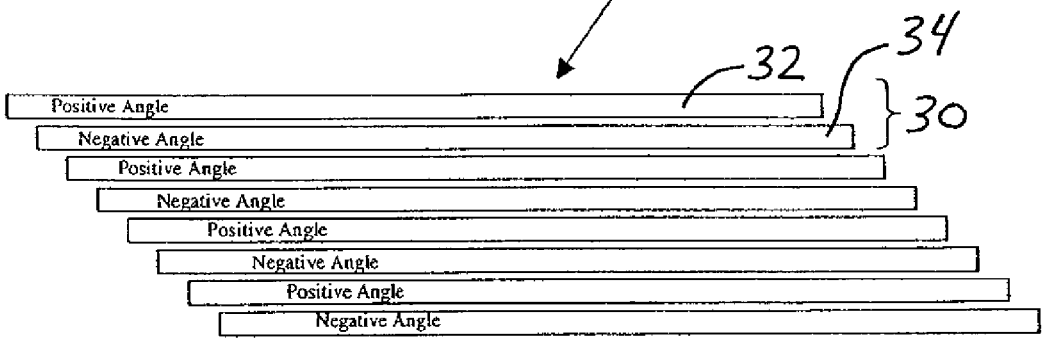
FIG. 3A

SINGLE WALL BALL BAT INCLUDING QUARTZ STRUCTURAL FIBER

BACKGROUND

Hollow baseball and softball bats typically exhibit a "trampoline effect" when striking a baseball or softball. This trampoline effect is a direct result of the transfer of potential energy, which is stored in the local bat hoop mode as deformation, back to the ball in the form of kinetic energy. The trampoline effect is substantially optimized when the transfer of energy incurs minimal losses. This occurs when the ball is struck such that the strain recovery of the hoop mode barrel wall is in phase with the strain recovery of the ball. Under such conditions, maximum kinetic energy transfer to the ball may be realized.

The efficiency of this energy transfer to the ball can be measured as a coefficient of restitution (COR). The COR is determined by dividing the post impact ball velocity by the incident ball velocity, which represents the efficiency of energy transfer between the bat and the ball.

It is commonly believed that as the structural thickness or stiffness of the barrel wall is increased, in an effort to increase bat durability, the efficiency of kinetic energy transfer to the ball decreases. Thus, there is a direct relationship between barrel energy losses, due to stiffness, and performance. Barrel walls that are extremely thin typically perform well since they exhibit extremely high deformation (which is favorable for energy transfer), but they typically do not have good strength characteristics or durability. Barrel walls that are very thick, conversely, are typically very durable but do not efficiently transfer energy to the ball.

Double-wall or multi-wall bat barrels have been developed in an effort to increase barrel performance, while maintaining an overall wall thickness that provides sufficient barrel durability. Multi-walled bats expand the amount of deflection possible relative to a single-walled design by increasing the barrel compliance, specifically by reducing the hoop (radial) stiffness of the bat barrel. While multi-wall bats have generally been successful, they are typically more expensive to manufacture than single-wall bats. Thus, when budget or selling price is a controlling factor, single-wall bats may be desirable.

It was previously believed that single-wall composite bats would not perform well or be durable enough to justify investing significant time in their development. Single-wall bats have recently been developed, however, that include one or more polymer composite materials reinforced by three-dimensional fibers, such as woven or braided glass fibers. An example of a single-wall ball bat 5 including three-dimensional fibers 8 is shown in FIGS. 1 and 1A.

These three-dimensional fibers provide improved durability, relative to conventional polymer composite bats, without appreciably sacrificing performance. Single-wall composite ball bats including three-dimensional reinforcement fibers are, however, relatively complicated and expensive to manufacture. Thus, a need exists for single-wall composite ball bats that can be constructed using inexpensive, high volume process methods.

SUMMARY

A single-wall ball bat is made up of a series of layers or plies of unidirectional, two-dimensional, fibers having high strain energy properties. The plies are optionally layered upon each other in a lamina structure in which the fibers in one ply are oriented at opposing angles to the fibers in one or more neighboring plies. High purity quartz ($SiO_2$) fibers, which have very high strain energy properties, may optionally be used to construct at least a substantial portion of the barrel or other regions of the ball bat.

Other features and advantages of the invention will appear hereinafter. The features of the invention described above can be used separately or together, or in various combinations of one or more of them. The invention resides as well in sub-combinations of the features described.

BRIEF DESCRIPTION OF THE DRAWINGS

In the drawings, wherein the same reference number indicates the same element throughout the several views:

FIG. 1 is a side-sectional view of a prior art single-wall ball bat including three-dimensional fiber layers.

FIG. 1A is a partial magnified view of the three-dimensional fiber layers of the prior art ball bat shown in FIG. 1.

FIG. 2 is a side-sectional view of a single-wall ball bat including two-dimensional fiber layers.

FIG. 2A is a partial magnified view of the two-dimensional fiber layers of the ball bat shown in FIG. 2, according to one embodiment.

FIG. 3 is a partial magnified side view of the two-dimensional fiber layers shown in FIG. 2A.

FIG. 3A is a magnified side view of a series of lamina sets of the two-dimensional fiber layers shown in FIG. 3.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Turning now in detail to the drawings, as shown in FIG. 2, a baseball or softball bat 10, hereinafter collectively referred to as a "ball bat" or "bat," includes a handle 12, a barrel 14, and a transition region 16 or tapered section joining the handle 12 to the barrel 14. The free end of the handle 12 includes a knob 18 or similar structure. The barrel 14 is preferably closed off by a suitable cap, plug, rollover, or other end closure 20. The end closure 20 may be attached via press fit or adhesive, or by threading, pinning, or by another suitable method. The interior of the bat 10 is preferably hollow, allowing the bat 10 to be relatively lightweight so that ball players may generate substantial bat speed when swinging the bat 10.

The ball bat 10 preferably has an overall length of 20 to 40 inches, or 26 to 34 inches. The overall barrel diameter is preferably 2.0 to 3.0 inches, or 2.25 to 2.75 inches. Typical bats have diameters of 2.25, 2.625, or 2.75 inches. Bats having various combinations of these overall lengths and barrel diameters, as well as any other suitable dimensions, are contemplated herein. The specific preferred combination of bat dimensions is generally dictated by the user of the bat 10, and may vary greatly between users. Thus, the ball bat 10 may have greater or lesser dimensions than those described.

The entire ball bat 10 may be formed as "one piece" or two or more pieces, such as separate handle and barrel pieces. A one-piece bat design, as used herein, generally refers to the barrel 14, the transition region 16, and the handle 12 of the ball bat 10 having no gaps, inserts, jackets, or bonded structures that act to appreciably thicken the barrel wall(s). In such a design, the distinct laminate layers are preferably integral to the barrel structure so that they all act in unison under loading conditions. To construct this one-piece design, the layers of the bat 10 are preferably co-cured, and are therefore not made up of a series of connected tubes (e.g., inserts or jackets) that each have a separate wall thickness at the ends of the tubes.

As shown in FIG. 2A, the bat barrel 14 is preferably a single-wall structure made up of a series of layers 22 or plies of unidirectional, structural fibers. The fibers are preferably two-dimensional, meaning they are not woven or braided, and do not intersect the cylindrical plane of the ball bat 10. The unidirectional, structural fibers are preferably embedded in a resin matrix of epoxy, vinyl ester, polyester, urethane, nylon, or any other suitable resin. The fibers may optionally be pre-impregnated with the resin matrix material.

A substantial percentage of the fibers in the bat barrel 14 preferably have high strain energy properties so that the single-wall barrel 14 is able to sustain high impact applications. In one embodiment, high purity silica or quartz ($SiO_2$) fibers, which have very high strain energy properties, may be used to construct some or all of the barrel 14 or other bat regions. In one embodiment, the high purity quartz fibers comprise at least 99% quartz, or at least 99.5% quartz.

Commercially available Astroquartz® or Astroquartz II® fibers, which typically comprise at least 99.5% quartz fibers, and have a specific energy storage of approximately 31,300 psi, may be used in the bat barrel 14 or other bat regions to provide desired durability. By comparison, commonly used S-glass fibers typically have a specific energy storage of approximately 13,800 psi, and commonly used E-glass fibers typically have a specific energy storage of approximately 9900 psi. By using fibers with high specific energy storage properties, complex three-dimensional fiber configurations are not required to provide desired durability.

Additionally, Astroquartz® composite structures typically exhibit excellent damping properties relative to graphite and metal dominated structures, due to Astroquartz's® relatively low tensile Young's modulus, which is approximately 10.5 msi. Thus, when a significant portion of the ball bat 10 is constructed using Astroquartz® fibers, the ball bat 10 exhibits favorable vibration damping characteristics.

In one embodiment, at least 50%, or 50-90%, or 60-80% of the fibers in the bat barrel 14 or ball bat 10 comprise high purity quartz fibers. The remaining barrel layers may include structural fibers of glass, graphite, boron, carbon, aramid (e.g., Kevlar®), ceramic, metallic, and/or any other suitable structural fibrous materials. In one embodiment, the barrel 14 includes 50-80% high purity quartz fibers, 10-30% glass fibers, and 10-20% graphite fibers.

As illustrated in FIGS. 3 and 3A, the fiber layers 22 in the barrel 14 are preferably laid upon each other such that the fibers in neighboring layers are oriented at opposing angles to one another to form a lamina structure. The lamina structure may include one or more lamina sets 30, each including a pair of layers 22, with a first layer 32 including fibers oriented at a positive angle and a second layer 34 including fibers oriented at an opposing negative angle relative to the longitudinal axis of the ball bat 10. Multiple lamina sets 30 may be laid upon one another to form the desired barrel thickness.

In one embodiment, within one or more lamina sets 30, the positive angle at which the fibers in the first layer 32 are oriented is equal to or substantially equal to the absolute value of the negative angle at which the fibers in the second layer 34 are oriented. For example, the fibers in the first layer 32 in a lamina set may be oriented at 30°, 45°, or 60°, and the fibers in the second layer 34 in the lamina set may be oriented at a corresponding −30°, −45°, or −60°, respectively, relative to the longitudinal axis of the ball bat 10. The fibers in the first and second layers within a given lamina set 30 may of course be oriented at any other suitable angles. In one embodiment, in each or substantially each lamina set 30 in the ball bat 10, the positive angle at which the fibers in the first layer 32 are oriented is equal to or approximately equal to the absolute value of the negative angle at which the fibers in the second layer 34 are oriented.

In another embodiment, the positive and negative fiber orientations in at least 50% of the lamina sets 30 in the barrel 14 are the same as one another. In other words, within a group of at least 50% of the lamina sets 30 in the barrel 14, the first and second fiber orientations in one lamina set are the same as the first and second fiber orientations in the other lamina sets in the group. For example, in at least 50% of the lamina sets 30, the fibers in the first and second layers could be oriented at 60° and −60°, respectively.

The handle 12 and the transition region 16 may be made up of the same or different materials than those used to construct the barrel 14. For example, the handle 12 or transition region 16 may be made up of layers including fibers of quartz (e.g., Astroquartz II®), glass, graphite, boron, carbon, aramid (e.g., Kevlar®), ceramic, metallic, and/or any other suitable structural fibrous materials. Each composite ply in the barrel 14, handle 12, or transition region 16 preferably has a thickness of approximately 0.002 to 0.060 inches, or 0.005 to 0.008 inches. Any other suitable ply thickness may alternatively be used. The handle 12 or the transition region 16 may alternatively be made of a metal, such as aluminum alloy. Combinations of one or more composite materials and metals may also be used in one or more regions of the ball bat 10.

The ball bat 10 may be manufactured using any of a variety of processes, including resin transfer molding, compression molding, hand laying-up, filament winding, or any other suitable process. A robust manufacturing process such as bladder molding, for example, in which the ball bat 10 is formed around a solid mandrel or tool and then subsequently withdrawn and replaced with an inflatable bladder, may also be used to construct the ball bat 10.

Thus, while several embodiments have been shown and described, various changes and substitutions may of course be made, without departing from the spirit and scope of the invention. The invention, therefore, should not be limited, except by the following claims and their equivalents.

What is claimed is:

1. A ball bat, comprising:

a handle;

a single-wall barrel comprising a plurality of layers of unidirectional, two-dimensional fibers, wherein the fibers in the barrel comprise 50-80% high purity quartz fibers, 10-30% glass fibers, and 10-20% graphite fibers; and a transition region joining the handle to the barrel;

wherein the layers are arranged in a plurality of corresponding lamina pairs, with each lamina pair including a first layer including fibers oriented at a positive angle relative to a longitudinal axis of the ball bat, and a second layer including fibers oriented at a negative angle relative to a longitudinal axis of the ball bat.

2. The ball bat of claim 1 wherein the high purity quartz fibers comprise at least 99.5% quartz.

3. The ball bat of claim 1 wherein, within each lamina pair, the positive angle is equal to or substantially equal to the absolute value of the negative angle.

4. The ball bat of claim 1 wherein the fibers in at least 50% of the lamina pairs have the same angular orientations as one another.

5. The ball bat of claim 1 wherein, in at least one of the lamina pairs, the fibers in the first layer are oriented at 30°, 45°, or 60°, and the fibers in the second layer are oriented at a corresponding −30°, 45°, or 60°, relative to the longitudinal axis of the ball bat.

6. The ball bat of claim 1 wherein the fibers are embedded in a resin matrix comprising at least one of epoxy, vinyl ester, polyester, urethane, and nylon.

7. A ball bat, comprising:

a handle;

a single-wall barrel comprising a plurality of layers of unidirectional, two-dimensional fibers, with the layers laid upon one another such that the fibers in a given layer are oriented at opposing angles to the fibers in at least one neighboring layer, wherein the fibers comprise 50-80% high purity quartz fibers, 10-30% glass fibers, and 10-20% graphite fibers; and a transition region joining the handle to the barrel.

8. The ball bat of claim 7 wherein the high purity quartz fibers comprise at least 99.5% quartz.

9. The ball bat of claim 7 wherein the layers are arranged in a plurality of corresponding lamina pairs, with each lamina pair including a first layer including fibers oriented at a positive angle relative to a longitudinal axis of the ball bat, and a second layer including fibers oriented at a negative angle relative to a longitudinal axis of the ball bat.

10. The ball bat of claim 9 wherein, within each lamina pair, the positive angle is equal to or substantially equal to the absolute value of the negative angle.

11. The ball bat of claim 7 wherein the fibers are embedded in a resin matrix comprising at least one of epoxy, vinyl ester, polyester, urethane, and nylon.

12. The ball bat of claim 9 wherein the fibers in at least 50% of the lamina pairs have the same angular orientations as one another.

13. The ball bat of claim 9 wherein, within at least one of the lamina pairs, the fibers in the first layer are oriented at 30°, 45°, or 60°, and the fibers in the second layer are oriented at a corresponding −30°, −45°, or −60°, relative to the longitudinal axis of the ball bat.

14. The ball bat of claim 7 wherein 60-80% of the fibers in the barrel comprise high purity quartz fibers.

* * * * *

UNITED STATES PATENT AND TRADEMARK OFFICE

CERTIFICATE OF CORRECTION

PATENT NO. : 7,384,354 B2
APPLICATION NO. : 11/560499
DATED : June 10, 2008
INVENTOR(S) : William B. Giannetti It is certified that error appears in the above-identified patent and that said Letters Patent is hereby corrected as shown below:

Column 5, line 27, replace "–30°, 45°, or 60°," with -- –30°, –45°, or –60°, --.

Signed and Sealed this

Sixteenth Day of June, 2009

JOHN DOLL
*Acting Director of the United States Patent and Trademark Office*